US008870675B2

(12) United States Patent
Motokawa

(10) Patent No.: US 8,870,675 B2
(45) Date of Patent: Oct. 28, 2014

(54) IRON GOLF CLUB SET AND GOLF CLUB HEAD

(75) Inventor: Yuki Motokawa, Kobe (JP)

(73) Assignee: Dunlop Sports Co. Ltd., Kobe (JP)

( * ) Notice: Subject to any disclaimer, the term of this patent is extended or adjusted under 35 U.S.C. 154(b) by 158 days.

(21) Appl. No.: 13/584,296

(22) Filed: Aug. 13, 2012

(65) Prior Publication Data

US 2013/0053163 A1 Feb. 28, 2013

(30) Foreign Application Priority Data

Aug. 24, 2011 (JP) ..... 2011-182909

(51) Int. Cl.
*A63B 53/04* (2006.01)

(52) U.S. Cl.
USPC ..... 473/290; 473/328; 473/350

(58) Field of Classification Search
CPC ..... A63B 2053/005; A63B 2053/0433
See application file for complete search history.

(56) References Cited

U.S. PATENT DOCUMENTS

| | | | | | |
|---|---|---|---|---|---|
| 5,125,662 | A * | 6/1992 | Antonious | 473/314 |
| 5,380,009 | A * | 1/1995 | Henry et al. | 473/346 |
| 5,390,924 | A * | 2/1995 | Antonious | 473/328 |
| 5,690,556 | A * | 11/1997 | Condon | 473/252 |
| D410,057 | S * | 5/1999 | Ortiz | D21/752 |
| 6,056,649 | A * | 5/2000 | Imai | 473/328 |
| 6,416,422 | B1 * | 7/2002 | Nagai et al. | 473/328 |
| 6,962,537 | B2 * | 11/2005 | Johnson | 473/313 |
| D658,732 | S * | 5/2012 | Dolezel et al. | D21/759 |
| 2006/0094526 | A1 * | 5/2006 | Reed | 473/328 |
| 2011/0077101 | A1 | 3/2011 | Bennett et al. | |
| 2013/0072319 | A1 * | 3/2013 | Dolezel et al. | 473/290 |

FOREIGN PATENT DOCUMENTS

| | | | |
|---|---|---|---|
| CN | 1459321 | A | 12/2003 |
| CN | 102029053 | A | 4/2011 |
| JP | 10-263117 | A | 10/1998 |
| JP | 11-104282 | A | 4/1999 |
| JP | 3426576 | B2 * | 7/2003 |
| WO | WO 2004022171 | A1 * | 3/2004 |

* cited by examiner

*Primary Examiner* — Stephen L. Blau
(74) *Attorney, Agent, or Firm* — Birch Stewart Kolasch & Birch, LLP

(57) ABSTRACT

This set 2 includes n (n is an integer equal to or greater than 2) iron golf clubs. Each of the n clubs has a rail r1 extending backward from an intermediate position in a face-back direction of a sole. When a distance d1 between a leading edge Le and a rail starting point Sr is defined as d1(1), d1(2), . . . , d1($n$) in an ascending order of a real loft angle from the club having the smallest real loft angle, the set 2 satisfies the following relation:

$$d1(1) \leq d1(2) \leq \ldots \leq d1(n), \text{ and } d1(1) < d1(n).$$

Preferably, the set 2 satisfies the following relation:

$$d1(1) < d1(2) < \ldots < d1(n).$$

15 Claims, 22 Drawing Sheets

IRON GOLF CLUB SET AND GOLF CLUB HEAD

The present application claims priority on Patent Application No. 2011-182909 filed in JAPAN on Aug. 24, 2011, the entire contents of which are hereby incorporated by reference.

BACKGROUND OF THE INVENTION

1. Field of the Invention

The present invention relates to an iron golf club set (iron set) and a golf club head.

2. Description of the Related Art

An iron set having a plurality of iron type golf clubs (iron clubs) is commercially available. Usually, the iron set includes a plurality of clubs having different real loft angles, lie angles, and lengths. Each of the clubs constituting the set is distinguished by an iron number. Specification of a head is determined for each iron number based on various respects.

A ball placed on a ground (lawn or the like) has many opportunities to be hit by using the iron club. In shot with the iron club, a sole is brought into contact with the ground in many cases. An amateur golfer is apt to cause a duffing missed hit. Large ground resistance reduces a swing-through. The ground resistance becomes a problem even in heads except iron heads. Particularly, the ground resistance becomes a problem in a fairway wood, a utility type head, and a hybrid type head.

In respect of improving the swing-through, a head including a sole having a rail provided thereon has been proposed. Japanese Patent Application Laid-Open No. 11-104282 discloses a head including a stabilizer rail formed on a sole surface. The stabilizer rail is formed to extend to the back side of the head.

Japanese Patent Application Laid-Open No. 10-263117 discloses a head including a sole part having three or more ridges provided thereon. The ridge extends to the back part from the front part of the sole part. The ridge disposed in a central region is higher than the ridges disposed on a toe side and a heel side.

SUMMARY OF THE INVENTION

Since the projection end part of the stabilizer rail is viewed at address in the invention of Japanese Patent Application Laid-Open No. 11-104282, the invention gives an uncomfortable feeling. Ground resistance is insufficiently suppressed in Japanese Patent Application Laid-Open No. 10-263117. Particularly, a large degree of duffing increases the ground resistance.

The present inventor considered an iron set and a sole shape of a head from a respect different from that of the conventional technique. As a result, the present inventor attained a sole shape capable of exhibiting an effect different from that of the conventional technique.

It is an object of the present invention to provide an iron set and a golf club head which can reduce ground resistance.

An iron set according to the present invention includes n (n is an integer equal to or greater than 2) iron golf clubs. Each of the n clubs has a rail extending backward from an intermediate position in a face-back direction of a sole. When a distance d1 between a leading edge and a rail starting point is defined as d1(1), d1(2), . . . , d1($n$) in an ascending order of a real loft angle from the club having the smallest real loft angle, the set satisfies the following relation 1:

$$d1(1) \leq d1(2) \leq \ldots \leq d1(n), \text{ and } d1(1) < d1(n) \quad \text{[relation 1].}$$

Preferably, the set satisfies the following relation 2:

$$d1(1) < d1(2) < \ldots < d1(n) \quad \text{[relation 2].}$$

Preferably, the rail extends to a back face.

Preferably, the two rails are provided on a toe side, and a sole groove is formed between the two rails. Preferably, the two rails are provided on a heel side, and a sole groove is formed between the two rails.

Preferably, the sole grooves extend backward from the intermediate position in the face-back direction. When a distance d2 between the leading edge and a sole groove starting point is defined as d2(1), d2(2), . . . , d2($n$) in an ascending order of a real loft angle from the club having the smallest real loft angle, the set preferably satisfies the following relation 9:

$$d2(1) < d2(2) < \ldots < d2(n) \quad \text{[relation 9].}$$

Preferably, the rail is not brought into contact with a ground in a base state where a face center position Pc is a ground point.

A head according to the present invention includes: two rails extending backward from an intermediate position in a face-back direction of a sole and disposed on a toe side of a face center position Pc; and two rails extending backward from the intermediate position in the face-back direction of the sole and disposed on a heel side of the face center position Pc. The four rails are not brought into contact with a ground in a base state where the face center position Pc is a ground point.

Preferably, a sole groove is disposed between the two rails disposed on the toe side. Preferably, a sole groove is disposed between the two rails disposed on the heel side. Preferably, the sole grooves extend backward from the intermediate position in the face-back direction.

DESCRIPTION OF THE PREFERRED EMBODIMENTS

Hereinafter, the present invention will be described in detail based on the preferred embodiments with appropriate references to the accompanying drawings.

Definitions of terms in the present application are as follows.

[Base State]

The base state is a state where a contact point of a head and a level surface h is defined as a face center position Pc, and the head is placed on the level surface h at a predetermined real loft angle. In the base state, a center axis line z (shaft axis line) of a shaft hole of the head is provided in a vertical surface VP1. The vertical surface VP1 is perpendicular to the level surface h. In the base state, a face surface is inclined to the vertical surface VP1 at a real loft angle. When contact of a sole and the level surface h is surface contact, the contact point is defined as a centroid of the contact surface. The predetermined real loft angle is described in, for example, a product catalog or the like.

[Toe-Heel Direction]

In the head of the base state, a direction of an intersection line between the vertical surface VP1 and the level surface h is the toe-heel direction. A toe side and a heel side used in the present application should be based on the toe-heel direction.

[Face-Back Direction]

A direction perpendicular to the toe-heel direction and parallel to the level surface h is the face-back direction. The face-back direction is also referred to as a front-back direction. A face side, a front side, a back side, and a rear side used in the present application should be based on the face-back direction.

[Face Center Position Pc]

A center position in the toe-heel direction of the longest face groove gv is the face center position Pc (see FIG. 12 to be described later).

Figure 1:
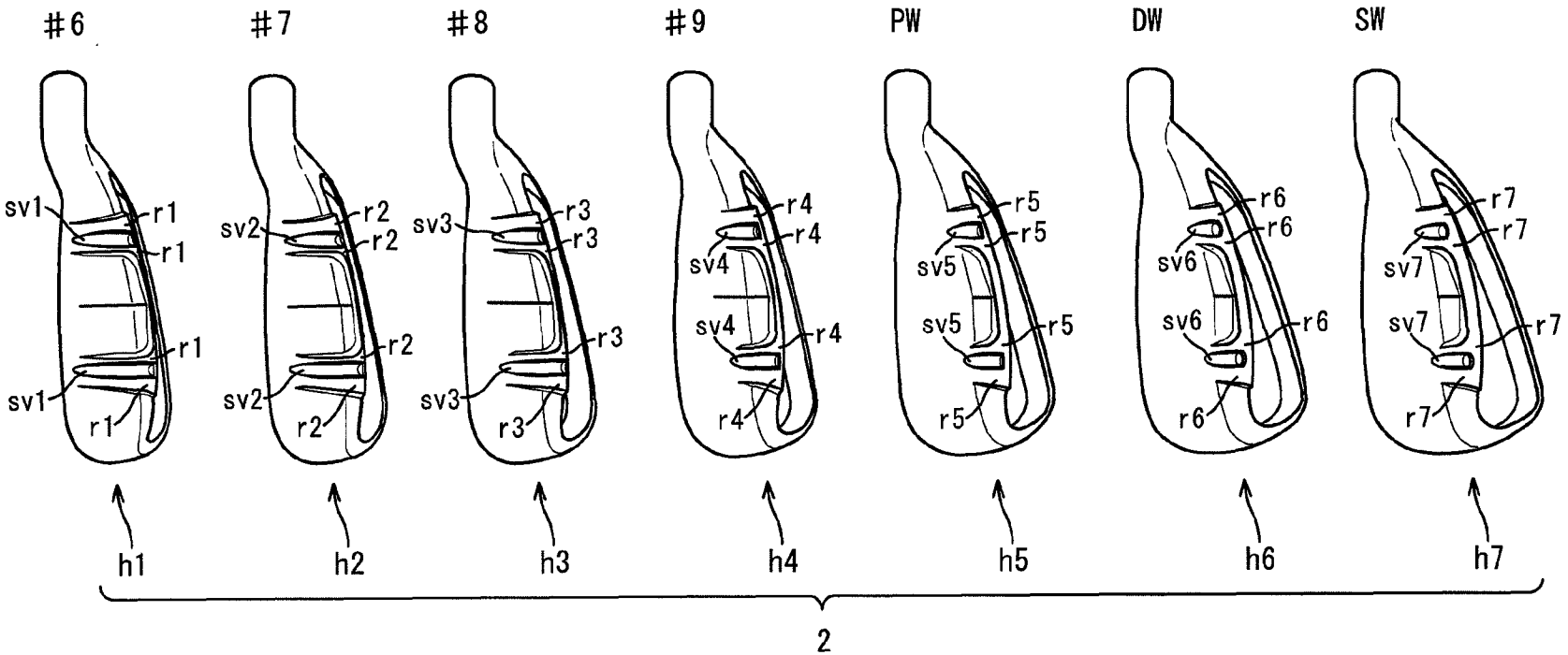
FIG. 1 is a bottom view showing a set according to a first embodiment of the present invention.

FIG. 1 shows a head set 2 used for a golf club set according to an embodiment of the present invention. The golf club set is an iron set. The number of clubs constituting the iron set maybe equal to or greater than 2. The club set is constituted by seven golf clubs. The real loft angle of an iron type golf club is usually 15 degrees or greater and 70 degrees or less.

Seven heads constituting the set 2 are a first head h1, a second head h2, a third head h3, a fourth head h4, a fifth head h5, a sixth head h6, and a seventh head h7 in an ascending order of a real loft angle from the head having the smallest real loft angle.

In the embodiment, the first head h1 is a 6-iron. The second head h2 is a 7-iron. The third head h3 is an 8-iron. The fourth head h4 is a 9-iron. The fifth head h5 is a pitching wedge (PW). The sixth head h6 is a dual wedge (DW). The seventh head h7 is a sand wedge (SW). The dual wedge (DW) is also referred to as an approach wedge (AW).

Although illustration is omitted, a shaft and a grip are attached to each of the heads h1 to h7. The length of the shaft is adjusted in order to adjust a club length. The lower an iron number is, the greater the club length is.

The total number m of the clubs of the iron set is equal to or greater than 2. In respect of enhancing the effect of the present invention, the total number m of the clubs is preferably equal to or greater than 4, more preferably equal to or greater than 5, and particularly preferably equal to or greater than 6. In the golf rule, the number of the clubs capable of being used during play is restricted. In this respect, the total number m of the clubs is preferably equal to or less than 11, more preferably equal to or less than 10, and still more preferably equal to or less than 9.

Figure 2:
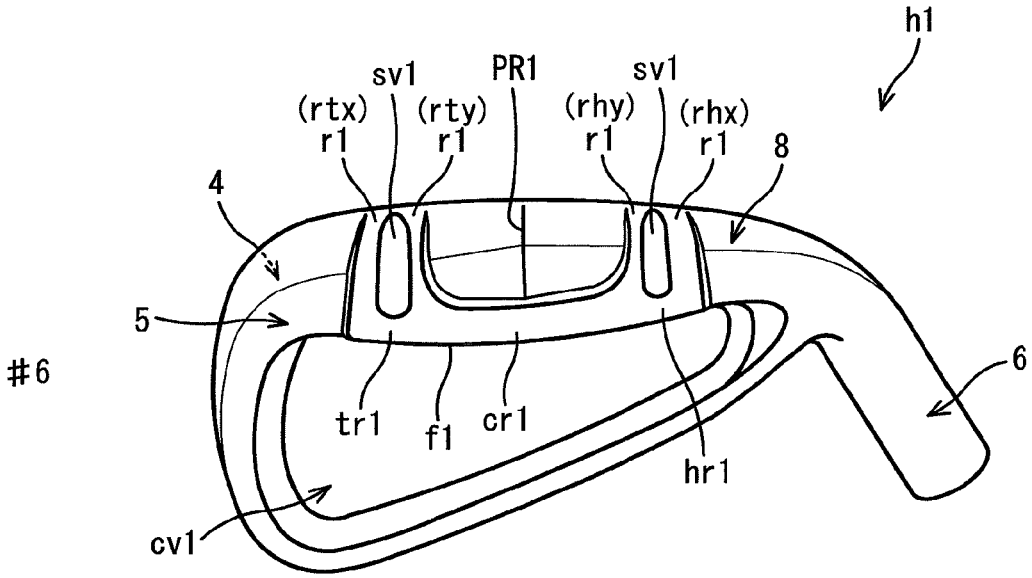
FIG. 2 is a perspective view of a head (6-iron) included in the set of FIG. 1.
Figure 3:
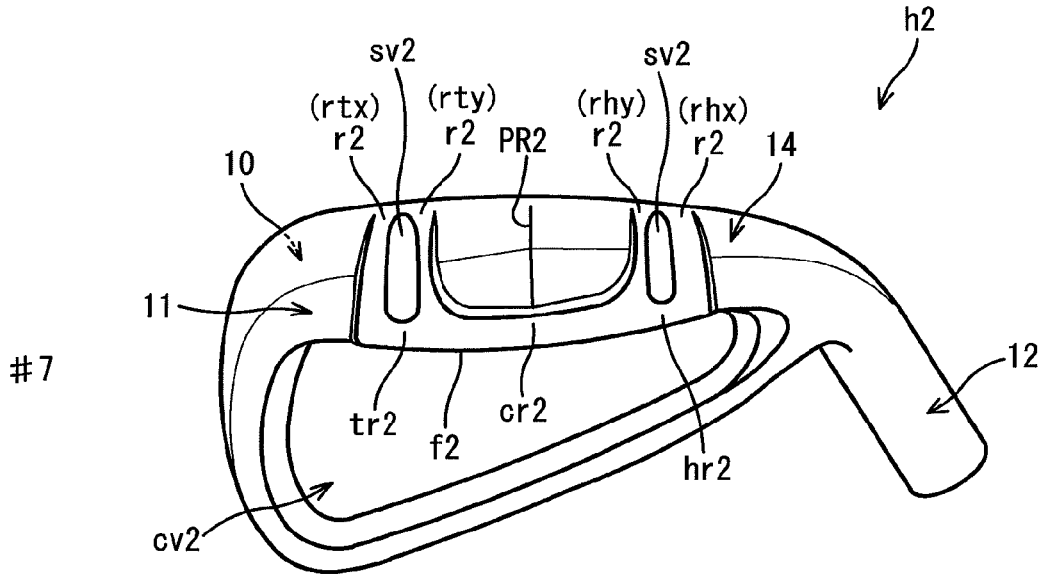
FIG. 3 is a perspective view of a head (7-iron) included in the set of FIG. 1.
Figure 4:
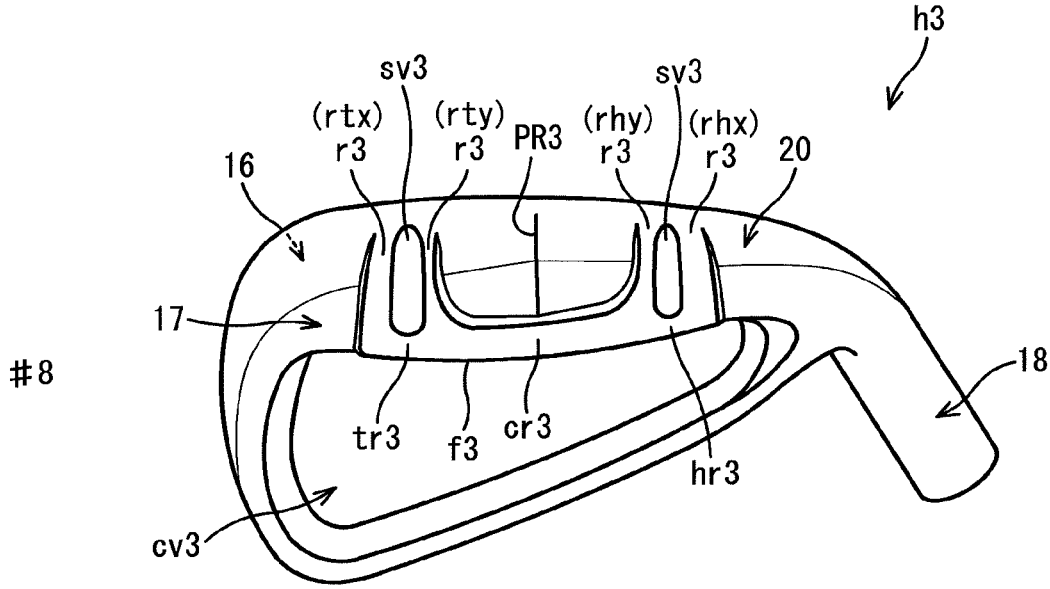
FIG. 4 is a perspective view of a head (8-iron) included in the set of FIG. 1.
Figure 5:
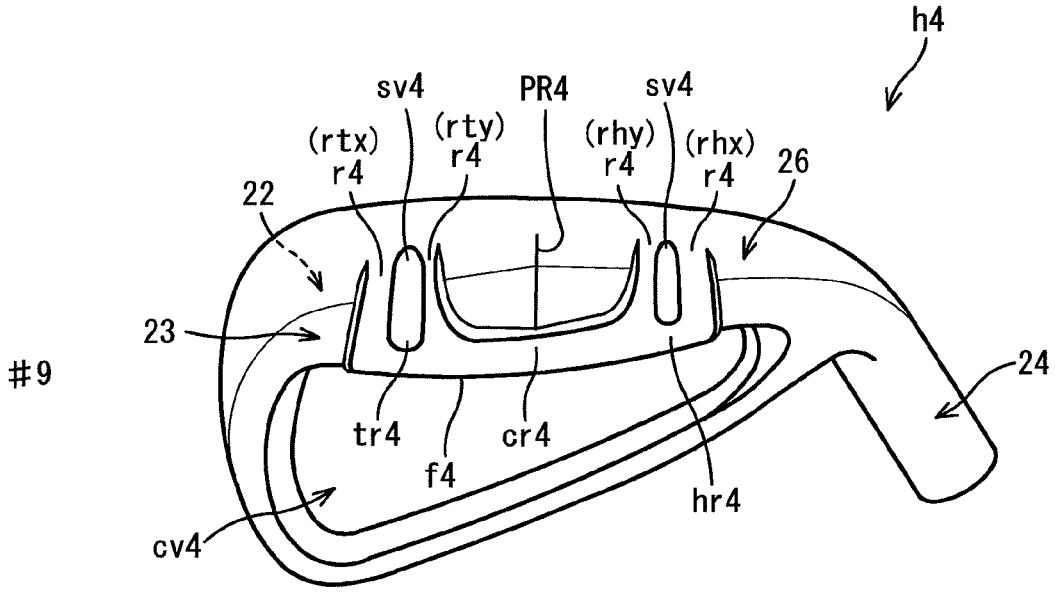
FIG. 5 is a perspective view of a head (9-iron) included in the set of FIG. 1.
Figure 6:
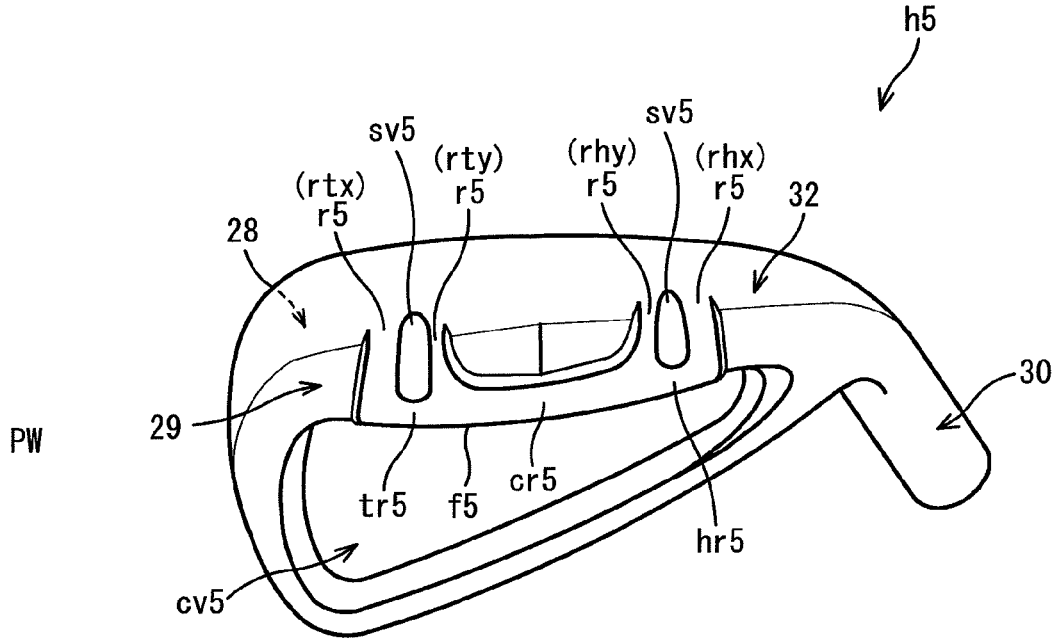
FIG. 6 is a perspective view of a head (pitching wedge) included in the set of FIG. 1.
Figure 7:
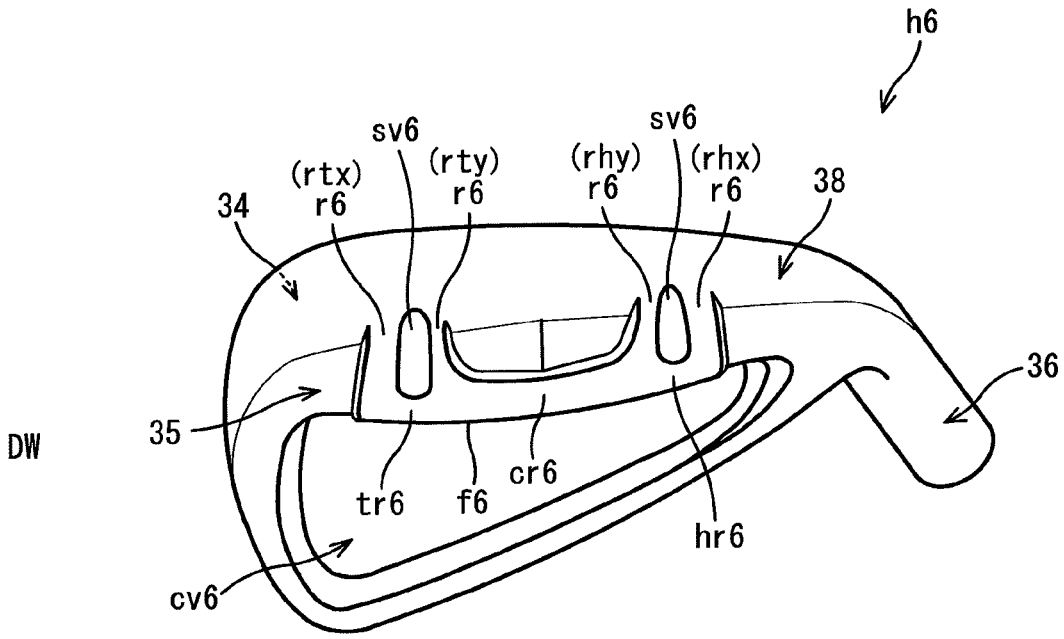
FIG. 7 is a perspective view of a head (dual wedge) included in the set of FIG. 1.
Figure 8:
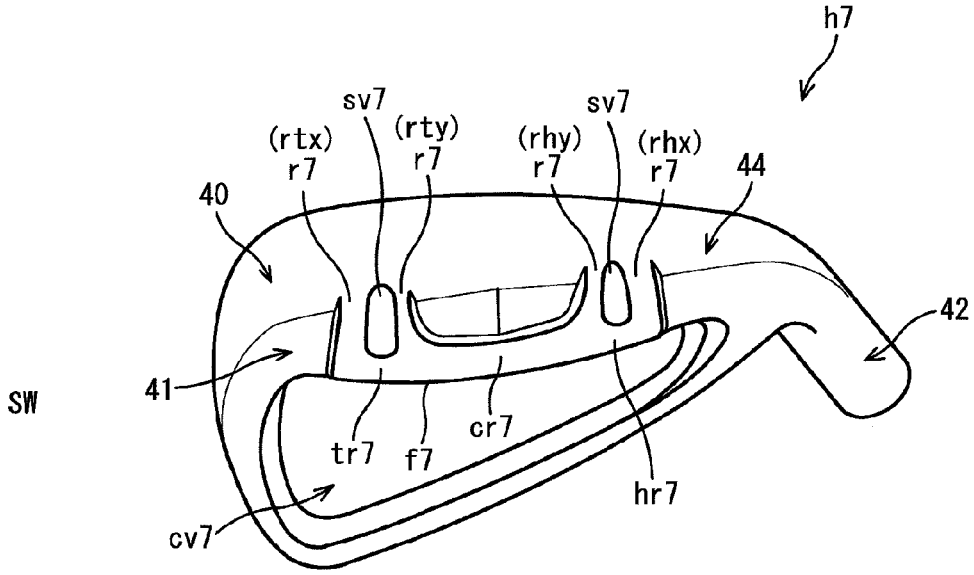
FIG. 8 is a perspective view of a head (sand wedge) included in the set of FIG. 1.

FIG. 2 is a perspective view of the head h1 (6-iron). FIG. 3 is a perspective view of the head h2 (7-iron). FIG. 4 is a perspective view of the head h3 (8-iron). FIG. 5 is a perspective view of the head h4 (9-iron). FIG. 6 is a perspective view of the head h5 (pitching wedge). FIG. 7 is a perspective view of the head h6 (dual wedge). FIG. 8 is a perspective view of the head h7 (sand wedge).

The head h1 has a face 4, a back face 5, a hosel 6, and a sole 8. The head h2 has a face 10, a back face 11, a hosel 12, and a sole 14. The head h3 has a face 16, a back face 17, a hosel 18, and a sole 20. The head h4 has a face 22, a back face 23, a hosel 24, and a sole 26. The head h5 has a face 28, a back face 29, a hosel 30, and a sole 32. The head h6 has a face 34, a back face 35, a hosel 36, and a sole 38. The head h7 has a face 40, a back face 41, a hosel 42, and a sole 44.

The back face 5 has a back cavity cv1. The back face 11 has a back cavity cv2. The back face 17 has a back cavity cv3. The back face 23 has a back cavity cv4. The back face 29 has aback cavity cv5. The back face 35 has a back cavity cv6. The back face 41 has a back cavity cv7. The heads h1 to h7 are cavity back irons. All the iron numbers are cavity back irons.

As shown in FIG. 2, the head h1 (6-iron) has a plurality of rails r1 provided on the sole 8. The number of the rails r1 is 4. The two rails r1 are provided on the toe side. The two rails r1 are provided on the heel side. The two rails r1 are provided on the toe side of the face center position Pc. The two rails r1 are provided on the heel side of the face center position Pc. The face center position Pc is determined on the basis of the longest face groove gv.

The rail r1 extends to the back face 5. All the rails r1 extend to the back face 5.

A head 2 may intrude into a ground (lawn) in impact. The intrusion is generated in a duffing missed hit, for example. The intrusion is generated in down blow shot, for example. The intruding head 2 is released from the ground at the final stage of the impact. When head 2 is released from the ground, not only the back part of the sole 8 but also the back face 5 may be brought into contact with the ground or the lawn. The rail r1 extending to the back face 5 smoothens the pass-through of the head (effect A). The rail r1 extending to the back face 5 increases a depth of a center of gravity of the head (effect B). The increased depth of the center of gravity can enlarge a sweet area, and can contribute to an increase in a flight distance.

The back face 5 has a toe link part tr1 linking the two toe side rails r1. The back face 5 has a heel link part hr1 linking the two heel side rails r1. The back face 5 has a center link part cr1 linking the toe link part tr1 and the heel link part hr1. The toe link part tr1, the heel link part hr1 and the center link part cr1 increase the depth of the center of gravity of the head (effect C). The effect C can be synergistical with the effect B.

The sole 8 has a sole groove sv1. Two sole grooves sv1 are formed. A first sole groove sv1 is formed between the two toe side rails r1. A second sole groove sv1 is formed between the two heel side rails r1.

The sole groove sv1 is adjacent to the two rails r1. One of side surfaces of the rail r1 constitutes the sole groove sv1. The height (height on the sole groove sv1 side) of the rail r1 is increased by the sole groove sv1. The depth of the sole groove sv1 is the height of the rail r1 on the sole groove sv1 side.

The depth of the sole groove sv1 is greater than a height of the rail r1 from the sole surface. The deep sole groove sv1 exhibits an effect equivalent to the increase of the height of the rail r1.

A too low rail reduces the basic function (a slide function and a reduction in a ground contact area) of the rail r1. On the other hand, a too high rail is apt to receive resistance from the ground, particularly, in the early stage of the impact.

The existence of the sole groove sv1 suppresses the projecting height from the sole surface and secures the height of the rail. The securement of the height of the rail improves the basic function of the rail r1. On the other hand, the suppression of the projecting height from the sole surface particularly suppresses ground resistance in the early stage. Thus, the sole groove sv1 can improve the basic function of the rail r1 and suppress a resistance force received by the rail from the ground (effect D).

Grass, soil, or sand may enter the sole groove sv1. The grass, the soil, or the sand can be discharged to the back side of the head 2 through the sole groove sv1. The discharge can reduce the ground resistance (effect E).

The sole groove sv1 extends to the back face 5. All the sole grooves sv1 extend to the back face 5. The extension can improve the discharge effect (effect F). That is, the extension can improve the effect E (discharge effect).

The rail r1 extends to an edge f1 of the back cavity cv1. All the rails r1 extend to the edge f1 of the back cavity cv1. The rail r1 forms a part of the edge f1 of the back cavity cv1. These constitutions improve the effect A and the effect B.

The toe link part tr1 forms a part of the edge f1 of the back cavity cv1. The heel link part hr1 forms a part of the edge f1 of the back cavity cv1. The center link part cr1 forms a part of the edge f1 of the back cavity cv1. These constitutions improve the effect C.

As shown in FIG. 3, the head h2 (7-iron) has a plurality of rails r2 provided on the sole 14. The number of the rails r2 is 4. The two rails r2 are provided on the toe side. The two rails r2 are provided on the heel side. The two rails r2 are provided on the toe side of the face center position Pc. The two rails r2 are provided on the heel side of the face center position Pc.

The rail r2 extends to the back face 11. All the rails r2 extend to the back face 11.

The back face 11 has a toe link part tr2 linking the two toe side rails r2. The back face 11 has a heel link part hr2 linking the two heel side rails r2. The back face 11 has a center link part cr2 linking the toe link part tr2 and the heel link part hr2.

The sole 14 has a sole groove sv2. Two sole grooves sv2 are formed. A first sole groove sv2 is formed between the two toe side rails r2. A second sole groove sv2 is formed between the two heel side rails r2.

The sole groove sv2 extends to the back face 11. All the sole grooves sv2 extend to the back face 11.

A smoothly continuous surface is formed by all the rails r2, the toe link part tr2, the heel link part hr2, and the center link part cr2.

The rail r2 extends to an edge f2 of the back cavity cv2. All the rails r2 extend to the edge f2 of the back cavity cv2. The rail r2 forms a part of the edge f2 of the back cavity cv2. The toe link part tr2 forms a part of the edge f2 of the back cavity cv2. The heel link part hr2 forms a part of the edge f2 of the back cavity cv2. The center link part cr2 forms a part of the edge f2 of the back cavity cv2.

As shown in FIG. 4, the head h3 (8-iron) has a plurality of rails r3 provided on the sole 20. The number of the rails r3 is 4. The two rails r3 are provided on the toe side. The two rails r3 are provided on the heel side. The two rails r3 are provided on the toe side of the face center position Pc. The two rails r3 are provided on the heel side of the face center position Pc.

The rail r3 extends to the back face 17. All the rails r3 extend to the back face 17.

The back face 17 has a toe link part tr3 linking the two toe side rails r3. The back face 17 has a heel link part hr3 linking the two heel side rails r3. The back face 17 has a center link part cr3 linking the toe link part tr3 and the heel link part hr3.

The sole 20 has a sole groove sv3. Two sole grooves sv3 are formed. A first sole groove sv3 is formed between the two toe side rails r3. A second sole groove sv3 is formed between the two heel side rails r3.

The sole groove sv3 extends to the back face 17. All the sole grooves sv3 extend to the back face 17.

A smoothly continuous surface is formed by all the rails r3, the toe link part tr3, the heel link part hr3, and the center link part cr3.

The rail r3 extends to an edge f3 of the back cavity cv3. All the rails r3 extend to the edge f3 of the back cavity cv3. The rail r3 forms a part of the edge f3 of the back cavity cv3. The toe link part tr3 forms a part of the edge f3 of the back cavity cv3. The heel link part hr3 forms a part of the edge f3 of the back cavity cv3. The center link part cr3 forms a part of the edge f3 of the back cavity cv3.

As shown in FIG. 5, the head h4 (9-iron) has a plurality of rails r4 provided on the sole 26. The number of the rails r4 is 4. The two rails r4 are provided on the toe side. The two rails r4 are provided on the heel side. The two rails r4 are provided on the toe side of the face center position Pc. The two rails r4 are provided on the heel side of the face center position Pc.

A rail r4 extends to the back face 23. All the rails r4 extend to the back face 23.

The back face 23 has a toe link part tr4 linking the two toe side rails r4. The back face 23 has a heel link part hr4 linking the two heel side rails r4. The back face 23 has a center link part cr4 linking the toe link part tr4 and the heel link part hr4.

The sole 26 has a sole groove sv4. Two sole grooves sv4 are formed. A first sole groove sv4 is formed between the two toe side rails r4. A second sole groove sv4 is formed between the two heel side rails r4.

The sole groove sv4 extends to the back face 23. All the sole grooves sv4 extend to the back face 23.

A smoothly continuous surface is formed by all the rails r4, the toe link part tr4, the heel link part hr4, and the center link part cr4.

The rail r4 extends to an edge f4 of the back cavity cv4. All the rails r4 extend to the edge f4 of the back cavity cv4. The rail r4 forms a part of the edge f4 of the back cavity cv4. The toe link part tr4 forms a part of the edge f4 of the back cavity cv4. The heel link part hr4 forms a part of the edge f4 of the back cavity cv4. The center link part cr4 forms a part of the edge f4 of the back cavity cv4.

As shown in FIG. 6, the head h5 (pitching wedge) has a plurality of rails r5. The number of the rails r5 is 4. The two rails r5 are provided on the toe side. The two rails r5 are provided on the heel side. The two rails r5 are provided on the toe side of the face center position Pc. The two rails r5 are provided on the heel side of the face center position Pc.

However, these rails r5 are not formed on the sole 32. These rails r5 are formed on the back face 29.

The back face 29 has a toe link part tr5 linking the two toe side rails r5. The back face 29 has a heel link part hr5 linking the two heel side rails r5. The back face 29 has a center link part cr5 linking the toe link part tr5 and the heel link part hr5.

The sole 32 has a sole groove sv5. Two sole grooves sv5 are formed. A first sole groove sv5 is formed between the two toe side rails r5. A second sole groove sv5 is formed between the two heel side rails r5.

The sole groove sv5 extends to the back face 29. All the sole grooves sv5 extend to the back face 29.

A smoothly continuous surface is formed by all the rails r5, the toe link part tr5, the heel link part hr5, and the center link part cr5.

The rail r5 extends to an edge f5 of the back cavity cv5. All the rails r5 extend to the edge f5 of the back cavity cv5. The rail r5 forms a part of the edge f5 of the back cavity cv5. The toe link part tr5 forms a part of the edge f5 of the back cavity cv5. The heel link part hr5 forms a part of the edge f5 of the back cavity cv5. The center link part cr5 forms a part of the edge f5 of the back cavity cv5.

As shown in FIG. 7, the head h6 (dual wedge) has a plurality of rails r6. The number of the rails r6 is 4. The two rails r6 are provided on the toe side. The two rails r6 are provided on the heel side. The two rails r6 are provided on the toe side of the face center position Pc. The two rails r6 are provided on the heel side of the face center position Pc. However, these rails r6 are not formed on the sole 38. These rails r6 are formed on the back face 35.

The back face 35 has a toe link part tr6 linking the two toe side rails r6. The back face 35 has a heel link part hr6 linking the two heel side rails r6. The back face 35 has a center link part cr6 linking the toe link part tr6 and the heel link part hr6.

The sole 38 has a sole groove sv6. Two sole grooves sv6 are formed. A first sole groove sv6 is formed between the two toe side rails r6. A second sole groove sv6 is formed between the two heel side rails r6.

The sole groove sv6 extends to the back face 35. All the sole grooves sv6 extend to back face 35.

A smoothly continuous surface is formed by all the rails r6, the toe link part tr6, the heel link part hr6, and the center link part cr6.

The rail r6 extends to an edge f6 of the back cavity cv6. All the rails r6 extend to the edge f6 of the back cavity cv6. The rail r6 forms a part of the edge f6 of the back cavity cv6. The toe link part tr6 forms a part of the edge f6 of the back cavity cv6. The heel link part hr6 forms a part of the edge f6 of the back cavity cv6. The center link part cr6 forms a part of the edge f6 of the back cavity cv6.

As shown in FIG. 8, the head h7 (sand wedge) has a plurality of rails r7. The number of the rails r7 is 4. The two rails r7 are provided on the toe side. The two rails r7 are provided on the heel side. The two rails r7 are provided on the toe side of the face center position Pc. The two rails r7 are provided on the heel side of the face center position Pc. However, these rails r7 are not formed on the sole 44. These rails r7 are formed on the back face 41.

The back face 41 has a toe link part tr7 linking the two toe side rails r7. The back face 41 has a heel link part hr7 linking the two heel side rails r7. The back face 41 has a central link part cr7 linking the toe link part tr7 and the heel link part hr7.

The sole 44 has a sole groove sv7. Two sole grooves sv7 are formed. A first sole groove sv7 is formed between the two toe side rails r7. A second sole groove sv7 is formed between the two heel side rails r7.

The sole groove sv7 extends to the back face 41. All the sole grooves sv7 extend to the back face 41.

A smoothly continuous surface is formed by all the rails r7, the toe link part tr7, the heel link part hr7, and the central link part cr7.

The rail r7 extends to an edge f7 of the back cavity cv7. All the rails r7 extend to the edge f7 of the back cavity cv7. The rail r7 forms a part of the edge f7 of the back cavity cv7. The toe link part tr7 forms a part of the edge f7 of the back cavity cv7. The heel link part hr7 forms a part of the edge f7 of the back cavity cv7. The central link part cr7 forms a part of the edge f7 of the back cavity cv7.

Hereinafter, the head h1 (6-iron), the head h4 (9-iron), and the head h7 (sand wedge) are illustrated as a representation example of a head group constituting the head 2.

Figure 9A:
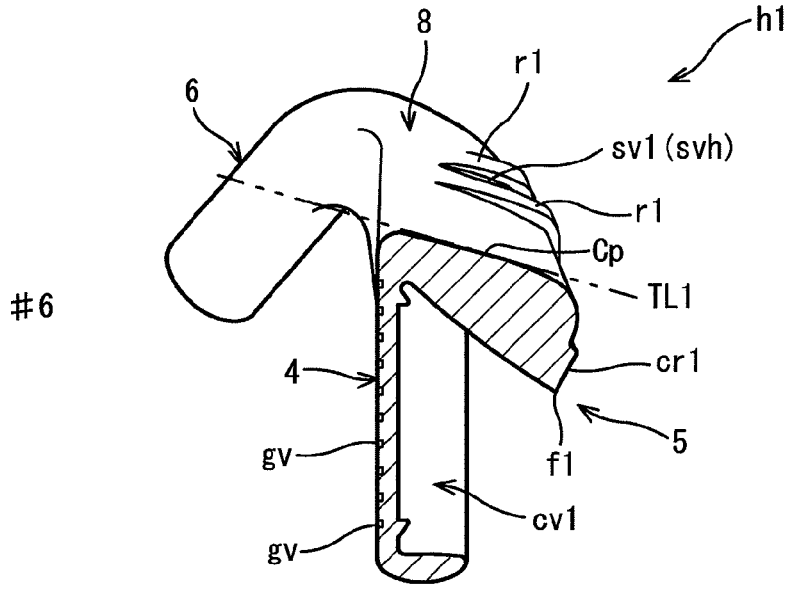
FIG. 9A is a partial cross sectional perspective view of the head (6-iron)
Figure 9B:
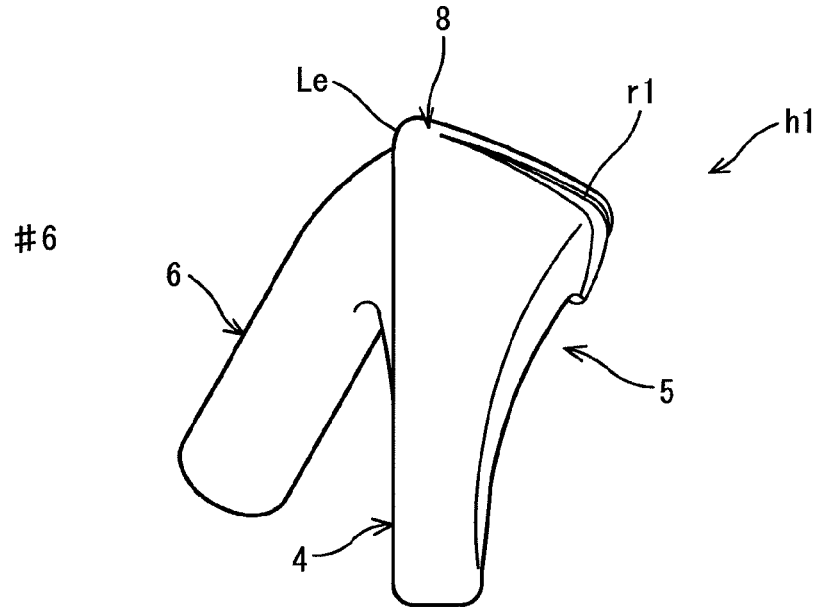
FIG. 9B is a side view of the head of FIG. 9A.
Figure 10A:
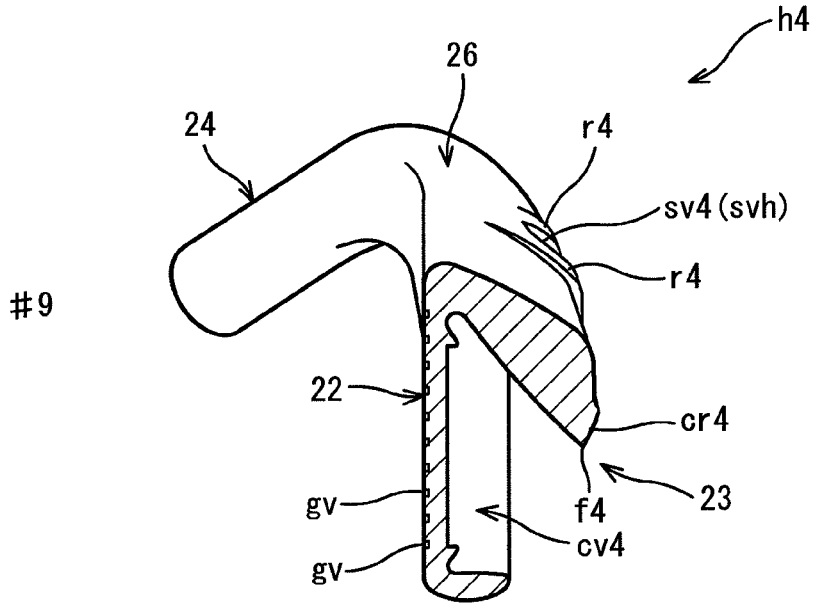
FIG. 10A is a partial cross sectional perspective view of the head (9-iron)
Figure 10B:
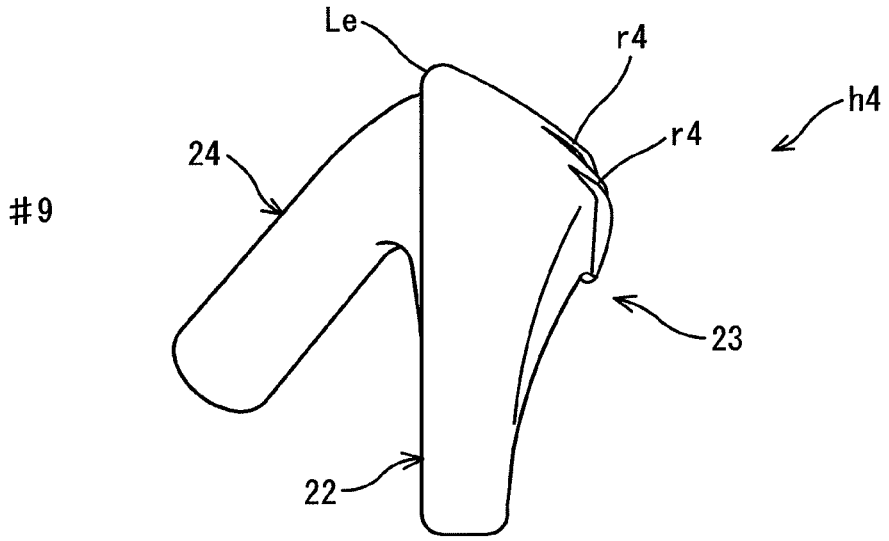
FIG. 10B is a side view of the head of FIG. 10A.
Figure 11A:
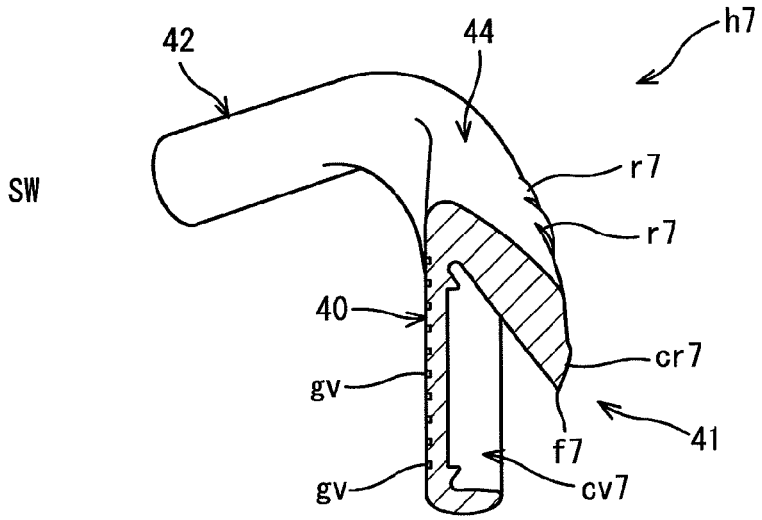
FIG. 11A is a partial cross sectional perspective view of the head (sand wedge)
Figure 11B:
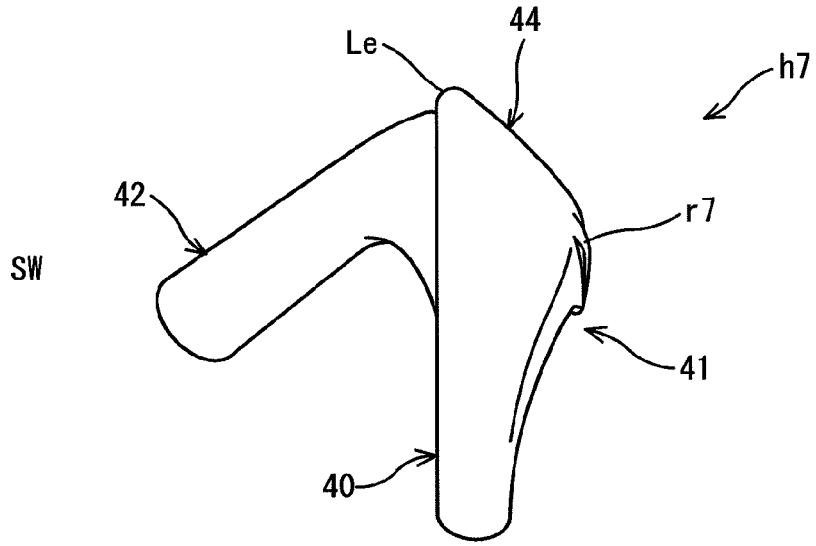
FIG. 11B is a side view of the head of FIG. 11A.

FIG. 9A is a partial cross sectional perspective view of the head h1 (6-iron). The section of FIG. 9A is a section at the face center position Pc. FIG. 9B is a side view of the head h1. FIG. 10A is a partial cross sectional perspective view of the head h4 (9-iron). The section of FIG. 10A is a section at the face center position Pc. FIG. 10B is a side view of the head h4. FIG. 11A is a partial cross sectional perspective view of the head h7 (sand wedge). The section of FIG. 11A is a section at the face center position Pc. FIG. 11B is a side view of the head h7.

As shown in FIG. 9A, the rail r1 extends backward from the intermediate position in the face-back direction of the sole 8. That is, in the sole 8, a portion having no rail exists between the rail r1 and a leading edge Le. The constitution is common in all the rails r1. The constitution is common in all the iron numbers h1 to h7. The portion having no rail collides with the ground in the early stage of the impact. Therefore, the rail does not collide with the ground in the early stage of the impact. The rail r1 provided at the back of the intermediate position in the face-back direction can suppress the ground resistance in the early stage of the impact (effect H).

As shown in FIG. 9A, in the front end part of the rail r1, the height of the rail r1 begins from zero, and is gradually increased. In the front end part of the rail r1, the surface of the rail r1 is smoothly continued to the surface of the sole 8. These constitutions are common in all the rails r1. These smooth continuities can reduce the ground resistance in the early stage of the impact (effect I). The constitution is common in all the iron number h1 to h7.

Figure 12:
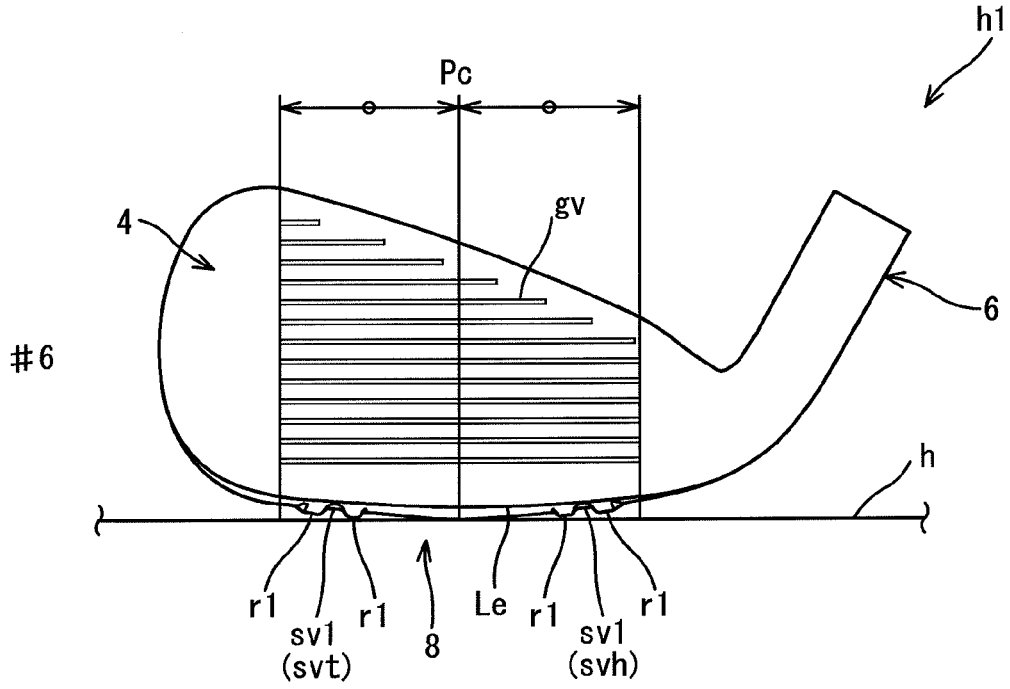
FIG. 12 is a front view of the head (6-iron)
Figure 13:
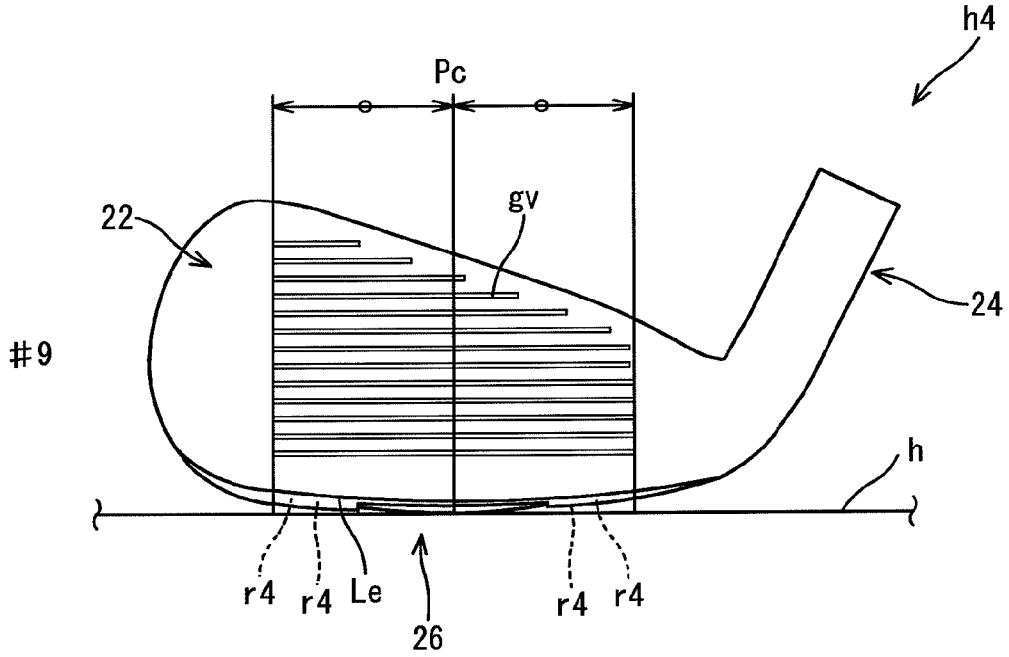
FIG. 13 is a front view of the head (9-iron)
Figure 14:
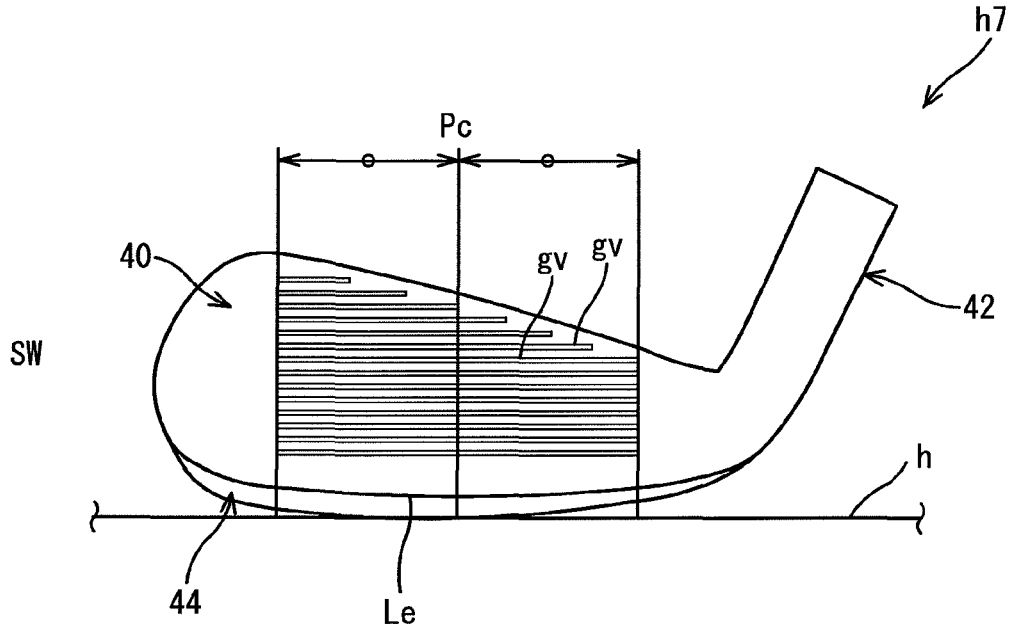
FIG. 14 is a front view of the head (sand wedge)

FIG. 12 is a front view of the head h1 (6-iron). In FIG. 12, the head h1 is in the base state. FIG. 13 is a front view of the head h4 (9-iron). In FIG. 13, the head h4 is in the base state. FIG. 14 is a front view of the head h7 (sand wedge). In FIG. 14, the head h7 is in the base state.

As shown in FIG. 12, the rail r1 is not brought into contact with a ground in the base state. That is, in the base state, the rail r1 is not brought into contact with the level surface h. In the base state, all the rails r1 are not brought into contact with the level surface h. The constitution can alleviate the resistance force caused by the collision of the rail r1 with the ground. The constitution can contribute to a reduction in the ground resistance (effect J). The constitution is common in all the iron numbers h1 to h7.

Figure 15:
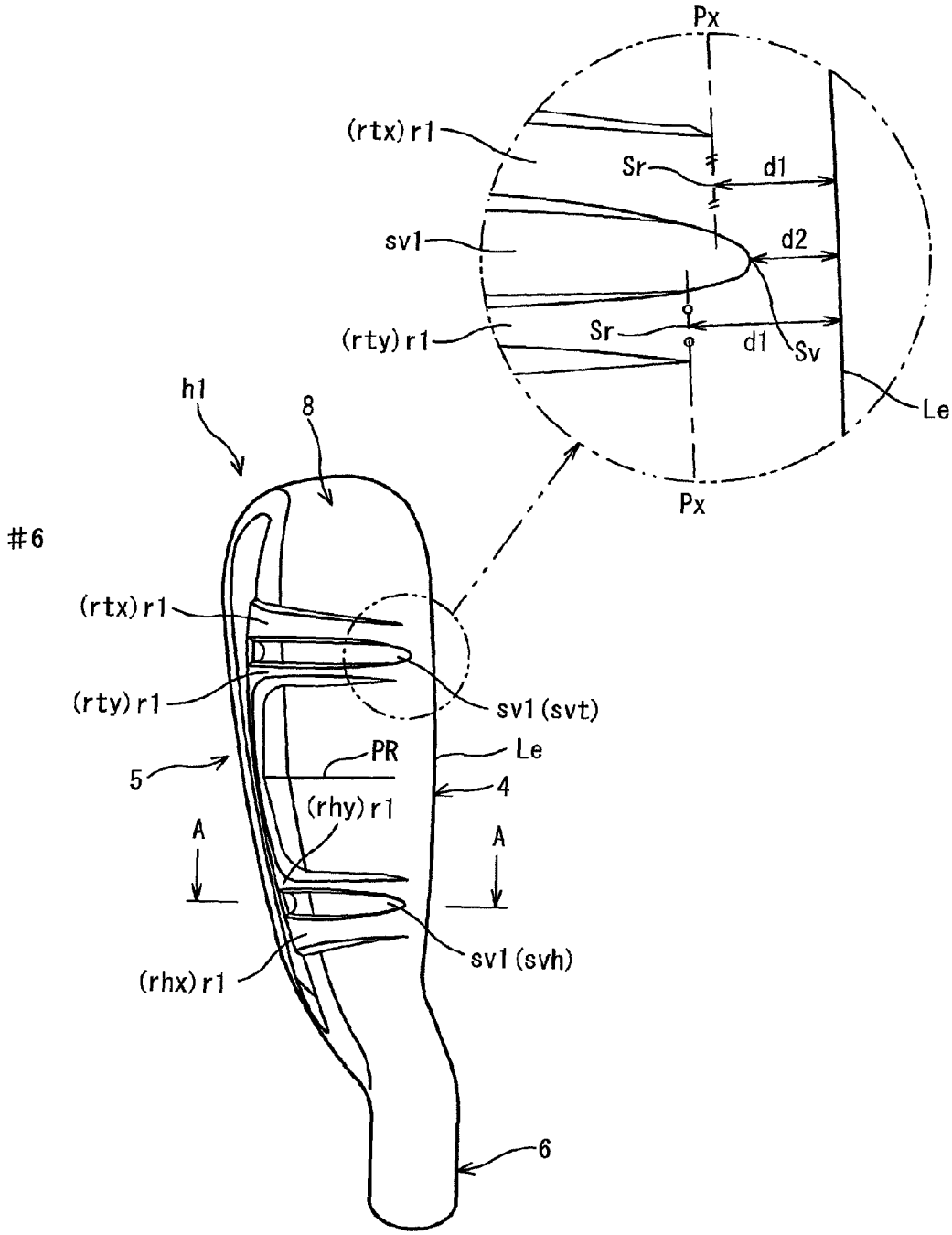
FIG. 15 is a bottom view of the head (6-iron)

FIG. 15 is a bottom view of the head h1 (6-iron). A rail starting point is represented by Symbol Sr in an enlarged part of FIG. 15.

[Rail Starting Point Sr]

In order to recognize the rail, a vertical interval (difference in height) is required for both the toe side and the heel side. That is, when either the toe side or the heel side has the vertical interval, the rail is not recognized. Therefore, in the embodiment of the enlarged part of FIG. 15, a sole groove starting point Sv is not the rail starting point Sr in the most toe side rail rtx. Similarly, the sole groove starting point Sv is not the rail starting point Sr also in the second rail rty from the most toe side.

In this respect, a position Px located on the most face side in a portion having a vertical interval on both the toe side and the heel side is determined (see an enlarged part of FIG. 15). The center position of the toe-heel direction at the position Px is defined as the rail starting point Sr (see the enlarged part of FIG. 15).

[Distance d1]

The distance d1 between the leading edge Le and the rail starting point Sr is measured along the face-back direction. The leading edge Le is a point located on the most front side in the base state (see FIG. 16 to be described later). The leading edge Le is set in each of positions in the toe-heel direction.

[Distance d2]

The distance d2 between the leading edge Le and the sole groove starting point Sv is measured along the face-back direction.

As shown in FIG. 15, in at least one sole groove sv1, the sole groove starting point Sv is located on the face side of each of the rail starting points Sr of the rails r1 adjacent to the both sides of the sole groove sv1. The constitution can improve the effect E.

Figure 16:
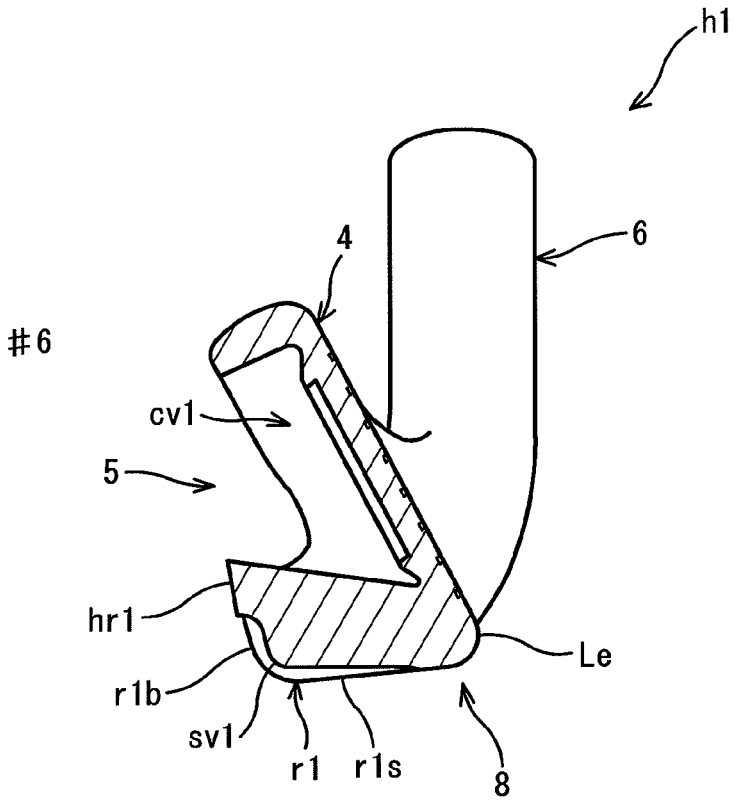
FIG. 16 is a cross sectional view taken along line A-A of FIG. 15.

FIG. 16 is a cross sectional view taken along line A-A of FIG. 15. As shown in FIG. 16, the surface (under surface) of the rail r1 is smoothly continued to the front side sole surface of the rail r1. The rail r1 has a rail part r1*s* located on the sole 8 and a rail part r1*b* located on the back face 5. As shown in FIG. 16, the surface of the rail part r1*s* and the surface of the rail part r1*b* are smoothly continued to each other.

Figure 17:
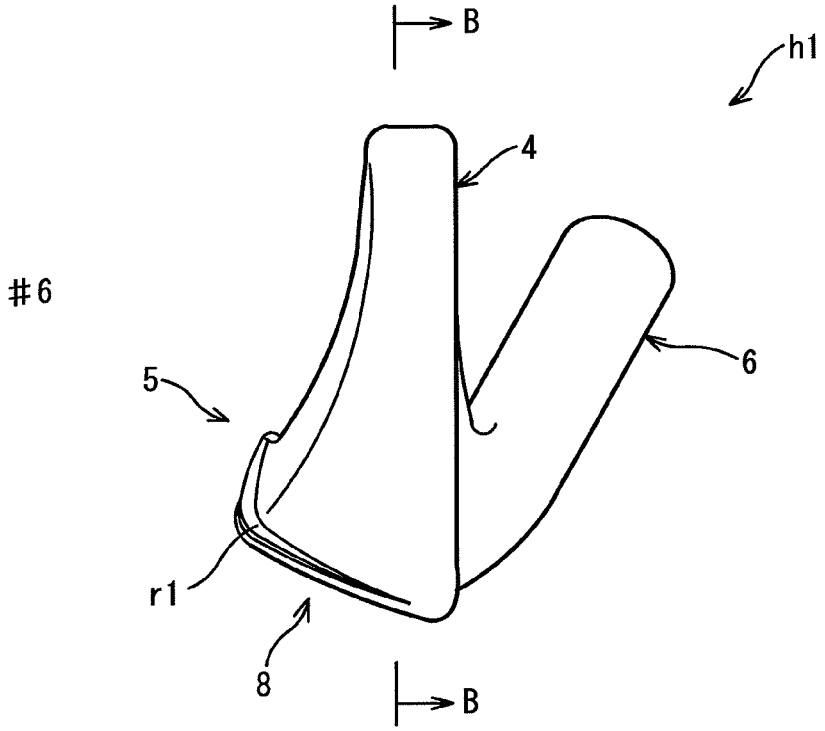
FIG. 17 is a side view of the head (6-iron)
Figure 18:
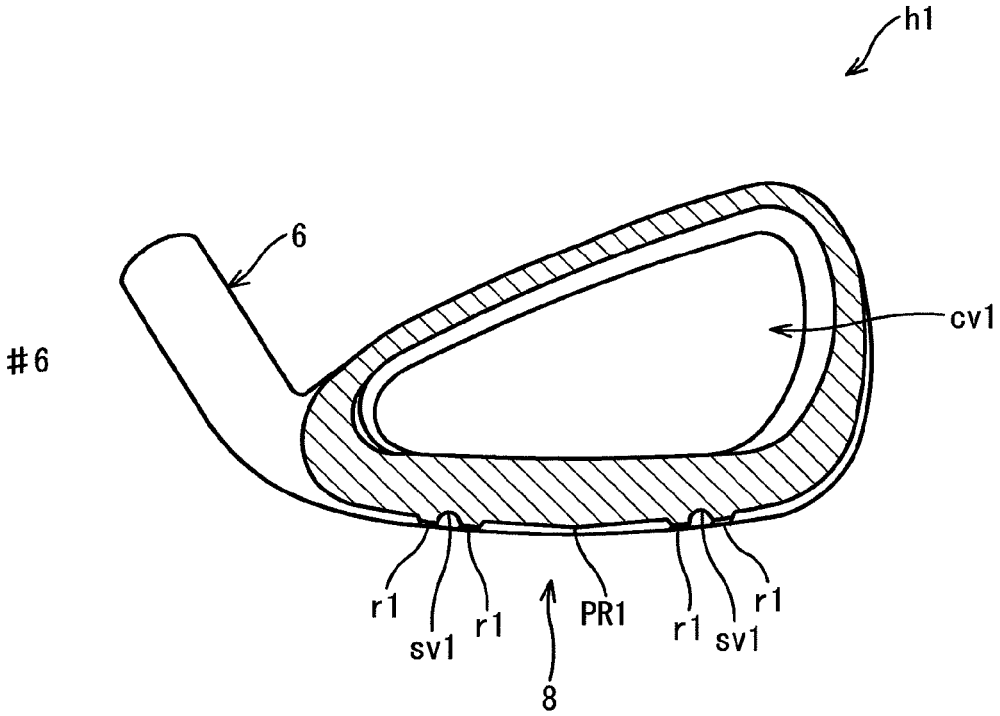
FIG. 18 is a cross sectional view taken along line B-B of FIG. 17.

FIG. 17 is a toe side view of the head h1 (6-iron). FIG. 18 is a sectional view taken along line B-B of FIG. 17. As shown in FIG. 18, a center convex part PR1 is provided between the toe side rail r1 and the heel side rail r1. In the base state, the center convex part PR1 is brought into contact with the level surface h.

The center convex part is provided on also other iron numbers. In the head h2 (7-iron), a center convex part PR2 is provided between the toe side rail r2 and the heel side rail r2 (see FIG. 3). In the head h3 (8-iron), a center convex part PR3 is provided between the toe side rail r3 and the heel side rail r3 (see FIG. 4). In the head h4 (9-iron), a center convex part PR4 is provided between the toe side rail r4 and the heel side rail r4 (see FIG. 5).

In the set 2, the head h1 (6-iron), the head h2 (7-iron), the head h3 (8-iron), and the head h4 (9-iron) have the rail extending backward from the intermediate position in the face-back direction of the sole. That is, in the embodiment, n=4 is set. n is an integer equal to or greater than 2. In the set 2, n is smaller than m. n may be equal to m.

On the other hand, the head h5 (pitching wedge), the head h6 (dual wedge), and the head h7 (sand wedge) do not have the rail extending backward from the intermediate position in the face-back direction of the sole. The total number of the set of the embodiment is 7. That is, m=7 is set.

The iron numbers having a real loft angle equal to or less than 42 degrees have the rail extending backward from the intermediate position in the face-back direction of the sole. The iron numbers having a real loft angle greater than 42 degrees do not have the rail extending backward from the intermediate position in the face-back direction of the sole.

All the iron numbers have the sole groove extending backward from the intermediate position in the face-back direction of the sole.

When the distance d1 is defined as d1(1), d1(2), . . . , d1(*n*) in an ascending order of a real loft angle from the club having the smallest real loft angle, the set 2 satisfies the following relation 1:

$$d1(1) \leq d1(2) \leq \ldots \leq d1(n), \text{ and } d1(1) < d1(n) \quad \text{[relation 1].}$$

Furthermore, the set 2 satisfies the following relation 2:

$$d1(1) < d1(2) < \ldots < d1(n) \quad \text{[relation 2].}$$

When the plurality of rails is present, the relation 1 or the relation 2 is determined in the corresponding rails. For example, in the embodiment, it is enough that the relation 1 or the relation 2 is satisfied, in the rail rtx located on the most toe side. In the rail rty located at the second position from the toe side, it is enough that the relation 1 or the relation 2 is satisfied. In a rail rhx located on the most heel side, it is enough that the relation 1 or the relation 2 is satisfied. In a rail rhy located at the second position from the heel side, it is enough that the relation 1 or the relation 2 is satisfied. That is, the relation 1 or 2 is preferably satisfied for at least one rail.

More preferably, in the rail rtx or the rail rty, and the rail rhx or the rail rhy, the relation 1 is satisfied. More preferably, in the rail rtx or the rail rty, and the rail rhx or the rail rhy, the relation 2 is satisfied. More preferably, in the rail rtx, the rail rty, the rail rhx, and the rail rhy, the relation 1 is satisfied. More preferably, in the rail rtx, the rail rty, the rail rhx, and the rail rhy, the relation 2 is satisfied.

When the plurality of rails is present and the plurality of distances d1 is measured, an average value d1*a* of the distances d1 can be calculated. When the average value d1*a* is defined as d1*a*(1), d1*a*(2), . . . , d1*a*(*n*) in an ascending order of a real loft angle from the club having the smallest real loft angle, the set 2 satisfies the following relation 3:

$$d1a(1) \leq d1a(2) \leq \ldots \leq d1a(n), \text{ and } d1a(1) < d1a(n) \quad \text{[relation 3].}$$

Furthermore, the set 2 satisfies the following relation 4:

$$d1a(1) < d1a(2) < \ldots < d1a(n) \quad \text{[relation 3].}$$

When the plurality of rails is present and the plurality of distances d1 is measured, the maximum value d1*b* of the distances d1 can be determined. When the maximum value d1*b* is defined as d1*b*(1), d1*b*(2), . . . , d1*b*(*n*) in an ascending order of a real loft angle from the club having the smallest real loft angle, the set 2 satisfies the following relation 5:

$$d1b(1) \leq d1b(2) \leq \ldots \leq d1b(n), \text{ and } d1b(1) < d1b(n) \quad \text{[relation 5].}$$

Furthermore, the set 2 satisfies the following relation 6:

$$d1b(1) < d1b(2) < \ldots < d1b(n) \quad \text{[relation 6].}$$

When the plurality of rails is present and the plurality of distances d1 is measured, the minimum value d1*c* of the distances d1 can be determined. When the maximum value d1*c* is defined as d1*c*(1), d1*c*(2), . . . , d1*c*(*n*) in an ascending order of a real loft angle from the club having the smallest real loft angle, the set 2 satisfies the following relation 7:

$$d1c(1) \leq d1c(2) \leq \ldots \leq d1c(n), \text{ and } d1c(1) < d1c(n) \quad \text{[relation 7].}$$

Furthermore, the set 2 satisfies the following relation 8:

$$d1c(1) < d1c(2) < \ldots < d1c(n) \quad \text{[relation 8].}$$

In the present application, the relations 1 to 8 are also collectively called "rail starting position flow". The difference of the club length or the like causes a different blow angle for each iron number. The specification of the optimal rail is different for each iron number. The rail can be optimized for each iron number by the rail starting position flow.

The distance d2 between the leading edge Le and the sole groove starting point Sv is defined as d2(1), d2(2), . . . , d2(*n*)

in an ascending order of a real loft angle from the club having the smallest real loft angle. At this time, the set 2 satisfies the following relation 9:

$$d2(1)<d2(2)<\ldots<d2(n) \quad \text{[relation 9].}$$

When the plurality of sole grooves is present, it is enough that the relation 9 is satisfied in the corresponding rail among iron numbers. For example, in the embodiment, it is enough that the relation 9 is satisfied in a sole groove svt located on the toe side. It is enough that the relation 9 is satisfied in a sole groove svh located on the heel side. Preferably, the relation 9 is satisfied in the sole groove svt or the sole groove svh. More preferably, the relation 9 is satisfied in the sole groove svt and the sole groove svh.

When the plurality of sole grooves is present and the plurality of distances d2 is measured, an average value d2*a* of the distances d2 can be calculated. When the average value d2*a* is defined as d2*a*(1), d2*a*(2), . . . , d2*a*(*n*) in an ascending order of a real loft angle from the club having the smallest real loft angle. At this time, the set 2 satisfies the following relation 10:

$$d2a(1)<d2a(2)<\ldots<d2a(n) \quad \text{[relation 10].}$$

When the plurality of sole grooves is present and the plurality of distances d2 is measured, a maximum value d2*b* of the distances d2 can be determined. The maximum value d2*b* is defined as d2*b*(1), d2*b*(2), . . . , d2*b*(*n*) in an ascending order of a real loft angle from the club having the smallest real loft angle. At this time, the set 2 satisfies the following relation 11:

$$d2b(1)<d2b(2)<\ldots<d2b(n) \quad \text{[relation 11].}$$

When the plurality of sole grooves is present and the plurality of distances d2 is measured, a minimum value d2*c* of the distances d2 can be determined. The minimum value d2*c* is defined as d2*c*(1), d2*c*(2), . . . , d2*c*(*n*) in an ascending order of a real loft angle from the club having the smallest real loft angle. At this time, the set 2 satisfies the following relation 12:

$$d2c(1)<d2c(2)<\ldots<d2c(n) \quad \text{[relation 12].}$$

In the present application, the relations 9 to 12 are also collectively called "sole groove starting position flow". The sole groove starting position flow can optimize a sole shape for each iron number.

[Real Loft Angle L1]

The real loft angle L1 of the head constituting the set 2 is defined as L1(1), L1(2), . . . , L1(*m*) in an ascending order of the real loft angle L1 from the club having the smallest real loft angle L1. In the set 2, the larger the iron number is, the larger the real loft angle L1 is. That is, the set 2 satisfies L1(1)<L1(2)< . . . <L1(*m*).

The set 2 includes a head having a real loft angle L1 equal to or less than 42 degrees and a head having a real loft angle L1 greater than 42 degrees. In the set 2, the heads having a real loft angle L1 equal to or less than 42 degrees are the 6-iron to the 9-iron. In the set 2, the heads having a real loft angle L1 greater than 42 degrees are the pitching wedge, the dual wedge, and the sand wedge.

[Bounce Angle θ1]

The bounce angle θ1 is measured at the face center position Pc. The bounce angle θ1 is determined in a section along the face-back direction. In measurement of the bounce angle θ1, a central point Cp of a sole section line at the face center position Pc is determined. An angle between a tangent line TL1 (see FIG. 9A) at the central point Cp and the level surface h is the bounce angle θ1. The bounce angle θ1 is measured in the head of the base state. The central point Cp is a central point of a sole width. The sole width is a face-back direction distance between the leading edge Le and a trailing edge. The central point Cp is a middle point based on the face-back direction distance. The trailing edge is a back side end of the sole. When roundness causes an unknown trailing edge, the trailing edge is a minimum point of a curvature radius.

When the bounce angle θ1 is defined as θ1(1), θ1(2), . . . , θ1(*m*) in an ascending order of a real loft angle from the club having the smallest real loft angle, the set 2 satisfies the following relation 13:

$$\theta1(1)\leq\theta1(2)\leq\ldots\leq\theta1(n), \text{ and } \theta1(1)<\theta1(n) \quad \text{[relation 13].}$$

Furthermore, the set 2 satisfies the following relation 14:

$$\theta1(1)\leq\theta1(2)\leq\ldots\leq\theta1(m), \text{ and } \theta1(1)<\theta1(m) \quad \text{[relation 14].}$$

Furthermore, the set 2 satisfies the following relation 15:

$$\theta1(1)<\theta1(2)<\ldots<\theta1(n) \quad \text{[relation 15].}$$

Furthermore, the set 2 satisfies the following relation 16:

$$\theta1(1)<\theta1(2)<\ldots<\theta1(m) \quad \text{[relation 16].}$$

In the present application, the relations 13 to 16 are also collectively called "bounce angle flow".

The bounce angle flow can optimize the function of the sole surface for each iron number. The club having a larger real loft angle tends to have stronger down blow. Ahead orbit (blow angle) is different for each iron number. The bounce angle flow corresponds to the head orbit. The bounce angle flow suppresses the rebound of the sole of the club having a small real loft angle on the ground. The bounce angle flow suppresses the sticking of the head of the club having a large real loft angle to the ground.

In the embodiment, the head having a real loft angle equal to or less than 42 degrees satisfies the relation 1 and the relation 2. In the embodiment, the head having a real loft angle greater than 42 degrees does not satisfy the relation 1 and the relation 2. The head having a real loft angle greater than 42 degrees has a large degree of down blow. Therefore, the existence of the rail may not contribute to a reduction in the ground resistance. When a rail is further added to the sole surface having a large bounce angle θ1, the rail may increase the ground resistance. In these respects, in the embodiment, the rail is not provided on the sole of the head having a real loft angle greater than 42 degrees.

The effect of the sole groove starting position flow is synergistical with the effect of the bounce angle flow. The iron number having a large real loft angle has a large bounce angle θ1. In this case, a sole groove starting position is moved to the back. Therefore, even when the blow angle is large, resistance caused by the collision of the head with the ground is alleviated. Accordingly, the ground resistance in the early stage of the impact can be suppressed. On the other hand, the iron number having a small real loft angle has a small bounce angle θ1. In this case, the sole groove starting position is moved to the front. Therefore, even when the bounce angle θ1 is small, the slip of the sole is improved. Accordingly, the ground resistance in the early stage of the impact can be suppressed.

Figure 19A:
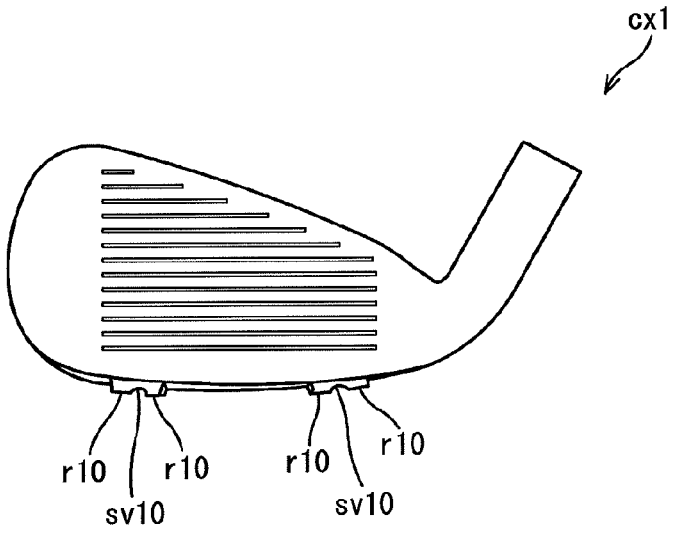
FIG. 19A is a front view of a head of a second embodiment.
Figure 19B:
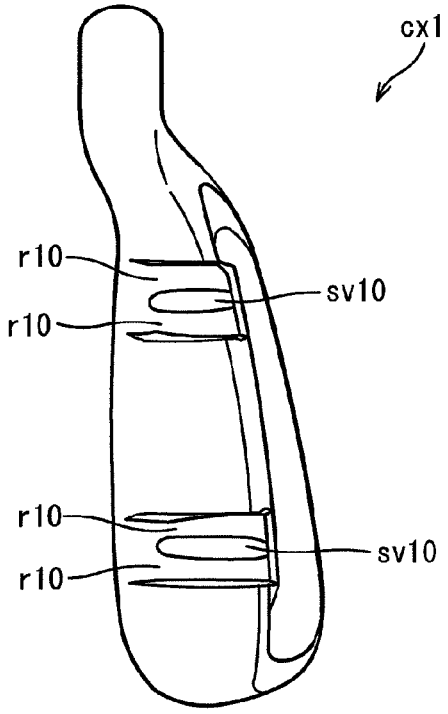
FIG. 19B is a bottom view of the head of FIG. 19A.

FIG. 19A is a front view of a head cx1 according to a second embodiment. FIG. 19A is a front view in the base state. FIG. 19B is a bottom view of the head cx1. The head cx1 is the same as the head h1 except for a rail shape and a sole groove shape.

Two rails r10 are provided on the toe side of the head cx1. A sole groove sv10 is formed between the two rails r10. The two rails r10 are provided on the heel side of the head cx1. The sole groove sv10 is provided between the two rails r10. All the rails r10 extend backward from the intermediate position in the face-back direction. All the sole grooves sv10 extend backward from the intermediate position in the face-back direction. The head cx1 is the 6-iron. In the head cx1, the two rails r10 are brought into contact with the level surface h in the base state. Therefore, the head cx1 can exhibit not the effect J but the other effects.

Figure 20A:
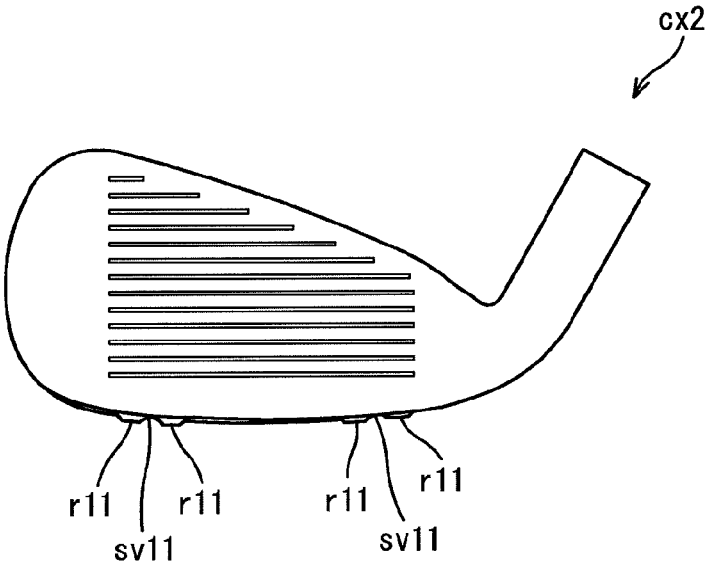
FIG. 20A is a front view of a head of a third embodiment.
Figure 20B:
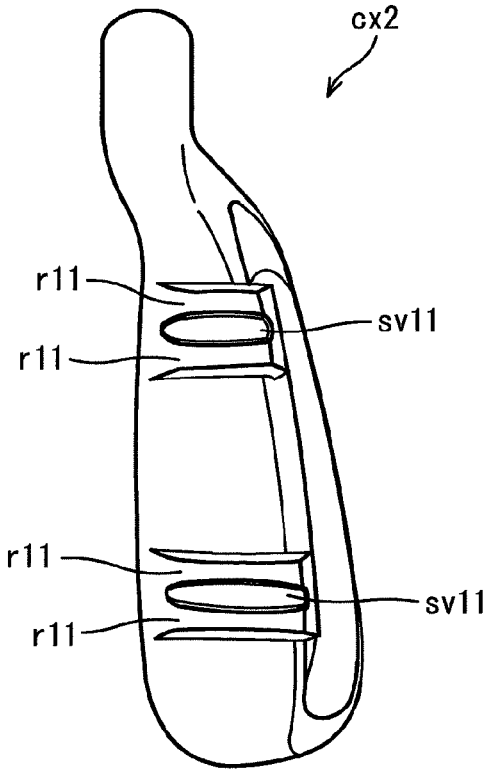
FIG. 20B is a bottom view of the head of FIG. 20A.

FIG. 20A is a front view of a head cx2 according to a third embodiment. FIG. 20B is a bottom view of the head cx2. FIG. 20A is a front view in the base state. The head cx2 is the same as the head h1 except for a rail shape and a sole groove shape.

Two rails r11 are provided on the toe side of the head cx2. A sole groove sv11 is formed between the two rails r11. Two rails r11 are provided on the heel side of the head cx2. The sole groove sell is formed between the two rails r11. All the rails r11 extend backward from the intermediate position in the face-back direction. All the sole grooves sy11 extend backward from the intermediate position in the face-back direction. The head cx2 is the 6-iron. In the head cx2, the two rails r11 are brought into contact with the level surface h in the base state. Therefore, the head cx2 can exhibit not the effect J but the other effects.

Figure 21A:
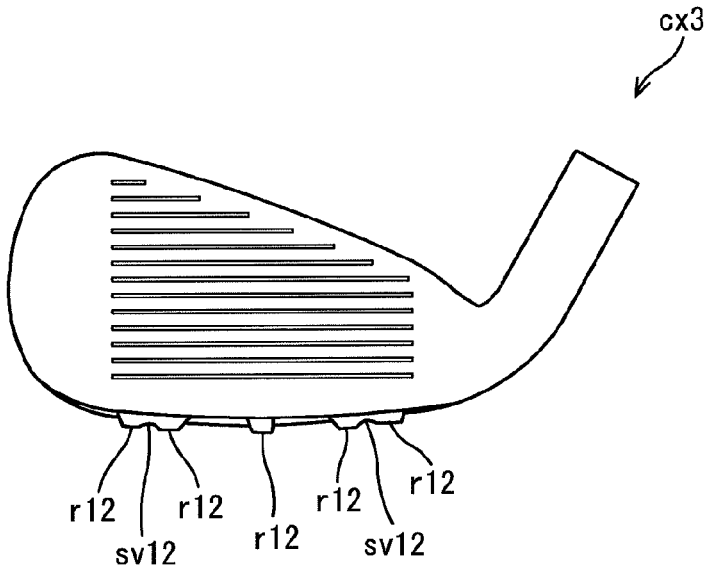
FIG. 21A is a front view of a head of a fourth embodiment.
Figure 21B:
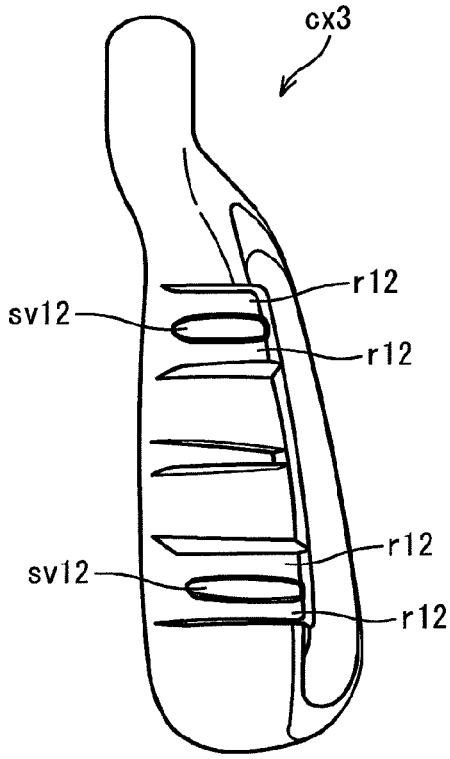
FIG. 21B is a bottom view of the head of FIG. 21A.

FIG. 21A is a front view of a head cx3 according to a fourth embodiment. FIG. 21B is a bottom view of the head cx3. FIG. 21A is a front view in the base state. The head cx3 is the same as the head h1 except for a rail shape and a sole groove shape.

Two rails r12 are provided on the toe side of the head cx3. A sole groove sv12 is formed between the two rails r12. Two rails r12 are provided on the heel side of the head cx3. The sole groove sv12 is formed between the two rails r12. Furthermore, a fifth rail r12 is provided on a central part in the toe-heel direction. The fifth rail r12 is provided at the face center position Pc. All the rails r12 extend backward from the intermediate position in the face-back direction. All the sole grooves sv12 extend backward from the intermediate position in the face-back direction. The head cx3 is the 6-iron. In the head cx3, the fifth rail r12 is brought into contact with the level surface h in the base state. Therefore, the head cx3 can exhibit not the effect J but the other effects.

Figure 22A:
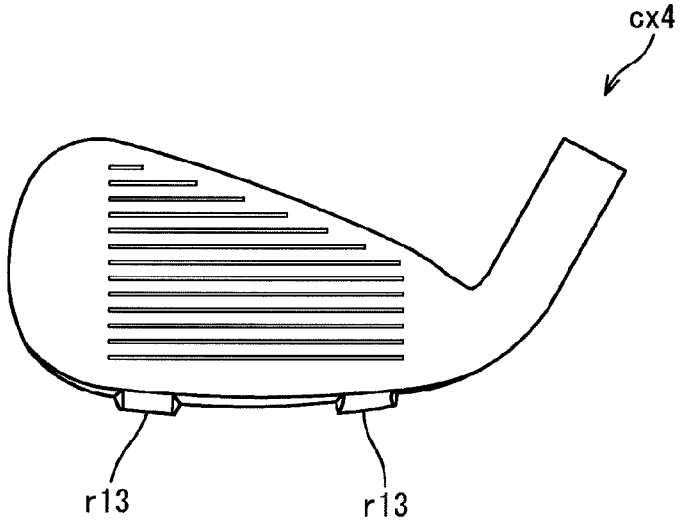
FIG. 22A is a front view of a head of a fifth embodiment.
Figure 22B:
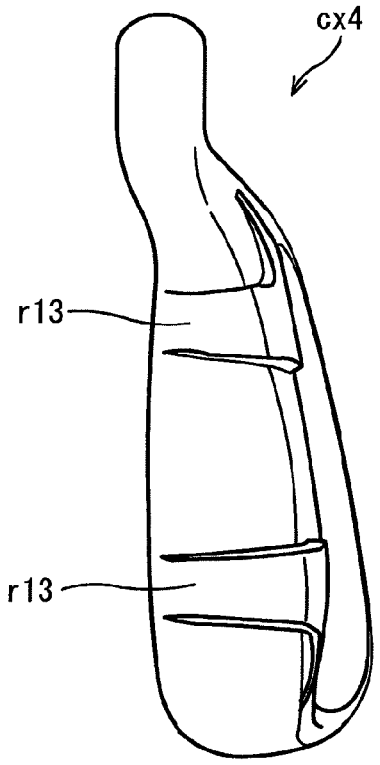
FIG. 22B is a bottom view of the head of FIG. 22A.

FIG. 22A is a front view of a head cx4 according to a fifth embodiment. FIG. 22B is a bottom view of the head cx4. FIG. 22A is a front view in the base state. The head cx4 is the same as the head h1 except for a rail shape and a sole groove shape.

One rail r13 is provided on the toe side of the head cx4. One rail r13 is provided on the heel side of the head cx4. The sole groove is not formed. All the rails r13 extend backward from the intermediate position in the face-back direction. The head cx4 is the 6-iron. In the head cx4, the two rails r13 are brought into contact with the level surface h in the base state. Therefore, the head cx4 does not exhibit the effect J. Since the sole groove is not formed in the head cx4, the head cx4 cannot exhibit the effects D, E, and F. The head cx4 can exhibit the other effects.

EXAMPLES

Hereinafter, the effects of the present invention will be clarified by examples. However, the present invention should not be interpreted in a limited way based on the description of the examples.

Example 1

The same set as the set 2 shown in FIG. 1 was produced. Stainless steel was cast, to obtain non-polished heads. Face grooves were formed by cut processing. The surfaces of the heads were polished, and the face surfaces of the heads were subjected to shot blast processing, to complete the heads. A shaft and a grip were attached to each of the heads, obtain the golf club set.

Club lengths of iron numbers were as follows.

6-iron: 37.25 inches
7-iron: 36.75 inches
8-iron: 36.25 inches
9-iron: 35.75 inches
pitching wedge: 35.25 inches
dual wedge: 35.25 inches
sand wedge: 35.125 inches Real loft angles of iron numbers were as follows.

6-iron: 27 (degrees)
7-iron: 31 (degrees)
8-iron: 35 (degrees)
9-iron: 39 (degrees)
pitching wedge: 44 (degrees)
dual wedge: 49 (degrees)
sand wedge: 54 (degrees)

Bounce angles θ1 of iron numbers were as follows.

6-iron: 8.0 (degrees)
7-iron: 8.3 (degrees)
8-iron: 8.5 (degrees)
9-iron: 8.7 (degrees)
pitching wedge: 9.0 (degrees)
dual wedge: 10.0 (degrees)
sand wedge: 12.0 (degrees)

Example 2

A head cx1 (only a 6-iron) shown in FIG. 19 was produced. The same grip and shaft as those of the 6-iron of the example 1 were attached, to obtain a club of example 2.

Example 3

A head cx2 (only a 6-iron) shown in FIG. 20 was produced. The same grip and shaft as those of the 6-iron of the example 1 were attached, to obtain a club of example 3.

Example 4

A head cx3 (only a 6-iron) shown in FIG. 21 was produced. The same grip and shaft as those of the 6-iron of the example 1 were attached, to obtain a club of example 4.

Example 5

A head cx4 (only a 6-iron) shown in FIG. 22 was produced. The same grip and shaft as those of the 6-iron of the example 1 were attached, to obtain a club of example 5.

Ten testers having handicap of 10 to 20 executed a trial hit. When the evaluations of the ten testers were put together, the example 1 was the best. The example 1 had less ground resistance and a better swing-through than those of the examples 2 to 5.

The set according to the present invention can be applied to all iron golf clubs. The head according to the present invention can be applied to all golf club heads. Examples of the head include an iron type head, a utility type head, a hybrid type head, and a fairway wood.

The description hereinabove is merely for an illustrative example, and various modifications can be made in the scope not to depart from the principles of the present invention.

What is claimed is:

1. A golf club set comprising n (n is an integer equal to or greater than 2) iron golf clubs, wherein each of the n clubs has a rail extending backward from an intermediate position in a face-back direction of a sole; and when a distance d1 between a leading edge and a rail starting point is defined as d1(1), d1(2), . . . , d1($n$) in an ascending order of a real loft angle from the club having the smallest real loft angle, the golf club set satisfies the following relation 1:

$$d1(1)<d1(2)\leq \ldots \leq d1(n), \text{ and } d1(1)<d1(n) \quad \text{[relation 1].}$$

2. The golf club set according to claim 1, wherein the golf club set satisfies the following relation 2:

$$d1(1)<d1(2)< \ldots <d1(n) \quad \text{[relation 2].}$$

3. The golf club set according to claim 1, wherein the rail extends to a back face.

4. The golf club set according to claim 1, wherein the two rails are provided on a toe side, and a sole groove is formed between the two rails; and the two rails are provided on a heel side, and a sole groove is formed between the two rails.

5. The golf club set according to claim 4, wherein the sole grooves extend backward from the intermediate position in the face-back direction; and when a distance d2 between the leading edge and a sole groove starting point is defined as d2(1), d2(2), . . . , d2($n$) in an ascending order of a real loft angle from the club having the smallest real loft angle, the golf club set satisfies d2(1)<d2(2)< . . . <d2($n$).

6. The golf club set according to claim 1, wherein the rail is not brought into contact with a ground in a base state where a face center position Pc is a ground point.

7. The golf club set according to claim 1, wherein each of the clubs has the plurality of rails; and when an average value d1$a$ of the distances d1 is defined as d1$a$(1), d1$a$(2), . . . , d1$a$($n$) in an ascending order of a real loft angle from the club having the smallest real loft angle, the golf club set satisfies the following relation 3:

$$d1a(1)\leq d1a(2)\leq \ldots \leq d1a(n), \text{ and } d1a(1)<d1a(n) \quad \text{[relation 3].}$$

8. The golf club set according to claim 7, wherein the golf club set satisfies the following relation 4:

$$d1a(1)<d1a(2)< \ldots <d1a(n) \quad \text{[relation 4].}$$

9. The golf club set according to claim 1, wherein each of the clubs has the plurality of rails; and when a maximum value d1$b$ of the distances d1 is defined as d1$b$(1), d1$b$(2), . . . , d1$b$($n$) in an ascending order of a real loft angle from the club having the smallest real loft angle, the golf club set satisfies the following relation 5:

$$d1b(1)\leq d1b(2)\leq \ldots \leq d1b(n), \text{ and } d1b(1)<d1b(n) \quad \text{[relation 5].}$$

10. The golf club set according to claim 9, wherein the golf club set satisfies the following relation 6:

$$d1b(1)<d1b(2)< \ldots <d1b(n) \quad \text{[relation 6].}$$

11. The golf club set according to claim 1, wherein each of the clubs has the plurality of rails; and when a minimum value d1$c$ of the distances d1 is defined as d1$c$(1), d1$c$(2), . . . , d1$c$($n$) in an ascending order of a real loft angle from the club having the smallest real loft angle, the golf club set satisfies the following relation 7:

$$d1c(1)\leq d1c(2)\leq \ldots \leq d1c(n), \text{ and } d1c(1)<d1c(n) \quad \text{[relation 7].}$$

12. The golf club set according to claim 11, wherein the golf club set satisfies the following relation 8:

$$d1c(1)<d1c(2)< \ldots <d1c(n) \quad \text{[relation 8].}$$

13. The golf club set according to claim 1, wherein the golf club set comprises m (m>n) iron golf clubs comprising a club having a real loft angle equal to or less than 42 degrees and having a rail; and a club having a real loft angle greater than 42 degrees and not having a rail.

14. The golf club set according to claim 1, wherein the golf club set includes a 6-iron;

the head of the 6-iron comprising:

two rails extending backward from an intermediate position in a face-back direction of sole and disposed on a toe side of a face center position Pc; and two rails extending backward from the intermediate position in the face-back position direction of the sole and disposed on a heel side of the face center position Pc, wherein the four rails of the 6-iron are not brought into contact with the ground in a base state where the face center position Pc is a ground point.

15. The golf club set according to claim 14, wherein a sole groove is disposed between the two rails disposed on the toe side of the 6-iron; and a sole groove is disposed between the two rails disposed on the heel side of the 6-iron;

wherein the sole grooves of the 6-iron extend backward from the intermediate position in the face-back direction.

* * * * *